US009238915B2

(12) United States Patent
Roseveare, Jr.

(10) Patent No.: US 9,238,915 B2
(45) Date of Patent: Jan. 19, 2016

(54) ASPHALT ROOF SHINGLE SEALING DEVICE

(71) Applicant: Ronald Newman Roseveare, Jr., Lynchburg, VA (US)

(72) Inventor: Ronald Newman Roseveare, Jr., Lynchburg, VA (US)

( * ) Notice: Subject to any disclaimer, the term of this patent is extended or adjusted under 35 U.S.C. 154(b) by 0 days.

(21) Appl. No.: 14/808,195

(22) Filed: Jul. 24, 2015

(65) Prior Publication Data

US 2015/0330082 A1 Nov. 19, 2015

Related U.S. Application Data

(63) Continuation-in-part of application No. 14/531,884, filed on Nov. 3, 2014.

(60) Provisional application No. 61/967,681, filed on Mar. 24, 2014.

(51) Int. Cl.

| | |
|---|---|
| ***E04D 1/36*** | (2006.01) |
| ***E04G 23/00*** | (2006.01) |
| ***E04D 13/00*** | (2006.01) |
| ***E04D 1/30*** | (2006.01) |

(52) U.S. Cl.
CPC *E04D 13/00* (2013.01); *E04D 1/30* (2013.01); *E04D 2001/308* (2013.01)

(58) Field of Classification Search
CPC ..... E04D 13/00; E04D 1/30; E04D 2001/308
USPC ..... 52/58, 60, 96, 459, 460, 464
See application file for complete search history.

(56) References Cited

U.S. PATENT DOCUMENTS 3,905,165 A 9/1975 Kneisel

OTHER PUBLICATIONS

The Slate Roof Bible, Understanding, Installing and Restoring the World's Finest Roof, Joseph Jenkins, 2nd Ed., Jan. 2009, Cover page, Forward page and p. 140.

*Primary Examiner* — Charles A Fox
*Assistant Examiner* — James Buckle, Jr.
(74) *Attorney, Agent, or Firm* — Henry J. Recla

(57) ABSTRACT

An asphalt roof shingle sealing device comprised of a single flat non-perforated blank sheet of metal or rigid plastic, preferably aluminum or copper and having a width, length and thickness selected to substantially span the beneath the width and length of a shingle to be repaired having at least one hole, tear or puncture therein and includes a cutting edge for cutting through adhesive between shingles to be repaired and securing elements for securing the blank sheet in place beneath the shingle to be repaired thereby preventing any water passing through the hole or puncture in the shingle, or allowing any water passing through the hole or puncture to be collected by the blank sheet and drained onto a shingle below the repaired shingle.

25 Claims, 5 Drawing Sheets

ASPHALT ROOF SHINGLE SEALING DEVICE

CROSS-REFERENCE TO RELATED APPLICATIONS

This application is a continuation-in-part application of copending non-provisional application Ser. No. 14/531,884 which claims benefit of provisional application No. 61/967,681.

STATEMENT REGARDING FEDERALLY SPONSORED RESEARCH OF DEVELOPMENT

Not applicable.

THE NAMES OF THE PARTIES TO A JOINT RESEARCH AGREEMENT

Not applicable.

INCORPORATION-BY-REFERENCE OF MATERIAL SUBMITTED ON A COMPACT DISC

Not applicable.

FIELD

This document generally relates to the field of roofing and devices for sealing and repairing damaged asphalt roof shingles.

BACKGROUND OF THE INVENTION

Asphalt roof shingles currently represent 80% of the residential roof market in the United States today. They vary in style, colors, and sizes and will continue to do so. They have a limited lifespan and are designed to be replaced multiple times during the life of the structure or home they are protecting. They are easily damaged by falling branches, hail, and often by homeowners, painters, satellite dish installers, chimney workers, and even roofers. Sometimes, the damage, in the form of holes, tears or punctures, are intentionally done by these contractors while installing equipment such as communication antennas and satellite dishes, solar panels or ladder brackets and roof safety equipment such as that disclosed in U.S. Pat. No. 8,549,793 and in our copending U.S. application Ser. No. 14/866,413. Other examples of such ladder brackets and safety equipment are disclosed in U.S. Patent application No. 2004/0135037 A1, U.S. Patent Application No. 2007/0278037 A1 and U.S. Pat. Nos. 5,896,719 and 8,549,793. The installation of these devices often requires the installer to drill or puncture holes through the asphalt shingles to drive anchors into the rafters or wood sheathing beneath the shingle layers in order to secure the ladder brackets or safety equipment to the roof. These anchors may include large common nails or screws. After the roofing job is completed and the ladder brackets and safety equipment are removed, any holes, tears, or punctures must be repaired to prevent water leaks through the shingles and into the interior of the building. Regardless of how the shingles are damaged, current methods of repairing such holes, tears, or punctures simply include coating and/or filling the holes or punctures with conventional roofing cement or sealant. Although such methods have proven to be satisfactory in the short term, they are costly, time consuming, messy, unattractive and distracting from the original beauty of the shingle. If done improperly the entire hole, tear or puncture may not be completely filled and sealed and the leak will continue. And even when done properly, these methods generally fail within 7 years due to exposure to sunlight and the cyclic hot and cold temperatures which crack or dislodge this type of repair. This becomes a repeating nuisance, leak and expense for the homeowner who might have 30 years of life remaining for their shingles. If the damage is too extensive, the shingles may need to be replaced entirely, which may lead into other problems such as matching the shingles with currently available shingles or finding an available experienced repair person. Such methods require other tools such as an injecting/caulking gun and tube of sealant, or a spatula for spreading the cement or sealant from a pale of cement.

As a solution to this problem, the present invention provides an asphalt shingle sealing device that eliminates any of the drawbacks of the current repairing methods discussed supra. The present invention relates generally to an asphalt roof shingle sealing device comprised of a single flat blank sheet of metal or rigid plastic. The present invention, as described hereinafter, includes a simple, non-messy, quick and easy-to-use asphalt shingle sealing device that eliminates the need to inject or coat roofing cement or sealant into the holes, tears or punctures as employed in the current methods.

BRIEF SUMMARY OF THE INVENTION

The present invention relates generally to an asphalt roof shingle sealing device comprised of a single flat blank sheet of metal or rigid plastic. When installed properly, this device is almost unnoticeable and the repair should last as long as the remaining lifetime of the shingle. The metal can be selected from any non-corrosive metal, preferably aluminum or copper. The plastic can be selected from any polymeric material such as polyvinylchloride (PVC) or equivalent thereof having a certain degree of rigidity. The blank sheet has a width, length and thickness selected to span the width and length of the punctured shingle such that it can be easily inserted underneath the shingle to be repaired. To facilitate the insertion, the blank sheet may include rounded upper corners. one or both of the rounded upper corners may have a series of saw teeth for cutting through adhesive between the overlapping shingles to be repaired. As described hereinbelow of the various embodiments, in the preferred method of use, the holes, tears or punctures are intended to be completely sealed. However, should any water passing through the holes, tears or punctures in the shingle will be collected by the blank sheet of the present invention and drained onto a shingle below the repaired shingle. Although several methods can be employed to secure the blank sheet in place underneath the repaired shingle, they are not all inclusive and not meant to limit the present invention in any manner.

For example, in a first embodiment, a pair of teeth extends normally, one from each lower corner of the blank sheet for partially penetrating a shingle below the repaired shingle.

In a second embodiment, a pair of teeth as described in the first embodiment and/or a layer of conventional flexible roof caulk, such as conventional roofing cement or sealant, is extended across the top surface of the blank sheet particularly in the area over which the holes, tears or punctures would be located. After inserting the blank sheet underneath a shingle to be repaired, the flexible roof caulk will adhere to the underside surface of the repaired shingle and also fill the hole or puncture thereby securing the blank sheet of the present invention in place.

In a third embodiment, a pair of teeth as described in the first embodiment and/or a layer of conventional flexible roof caulk is extended, such as conventional roofing cement or sealant, across the top surface of the blank sheet particularly in the area over which the holes, tears or punctures would be located. A peal-back strip is disposed over the layer of caulk which would then be removed once the blank sheet is inserted underneath a shingle-to-be-repaired. The peal-back strip may be folded over upon itself and extend beyond the lower edge of the blank sheet to facilitate the removal thereof after the blank sheet is in place. As in the first and second embodiments, the flexible roof caulk will adhere to the underside surface of the repaired shingle and also fill the hole or puncture thereby securing the blank sheet of the present invention in place. In this embodiment, the caulk and peel-back strip could be applied to the blank sheet by the user as desired, or alternatively, the caulk and peel-back strip could be applied to the blank sheet during the manufacturing process of the present invention. In the latter case, the peel-back strip will not only overlap the caulk, but will be seal to the top surface of the blank sheet around the periphery of the caulk to maintain the caulk in its uncured state until use.

BRIEF DESCRIPTIONS OF THE DRAWINGS

DETAILED DESCRIPTION OF THE INVENTION

Figure 1:
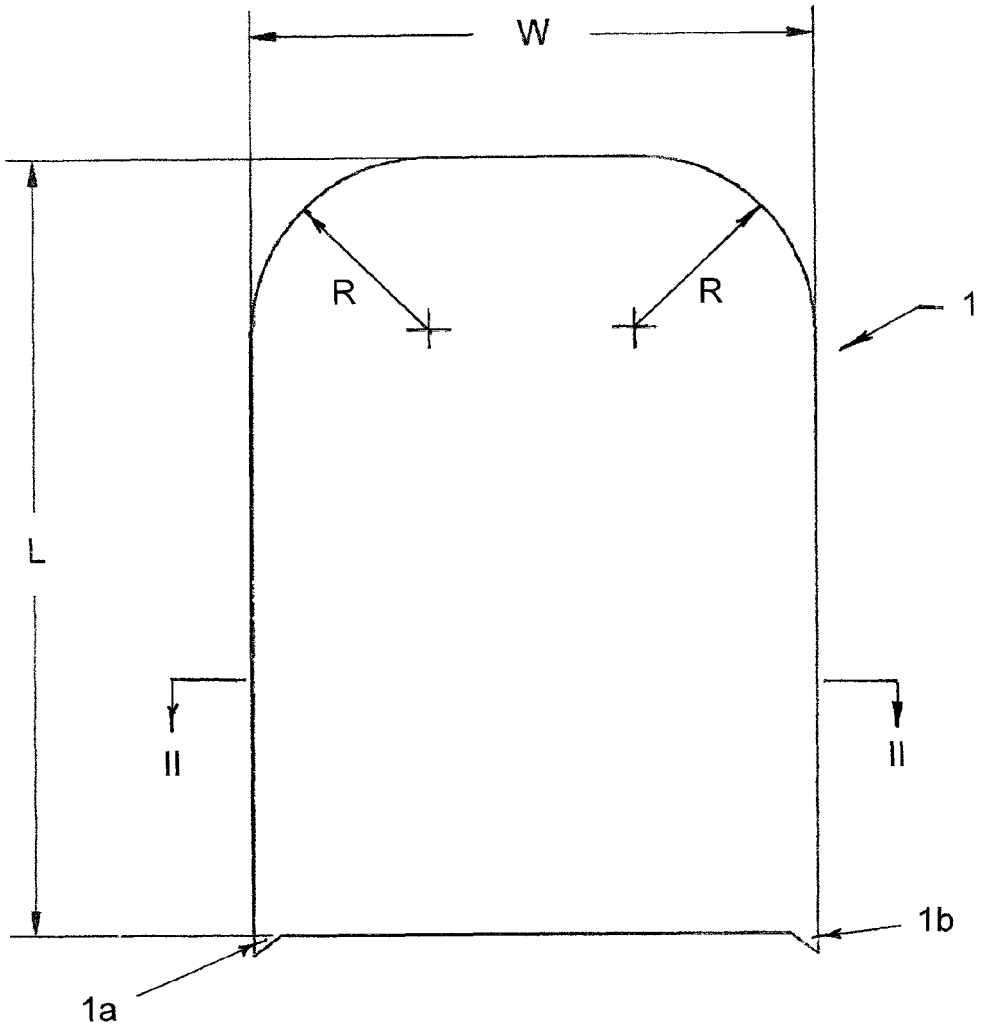
FIG. 1 shows a top view of the first embodiment of the present invention with the securing teeth extending in the plane of the flat blank sheet.
Figure 2:
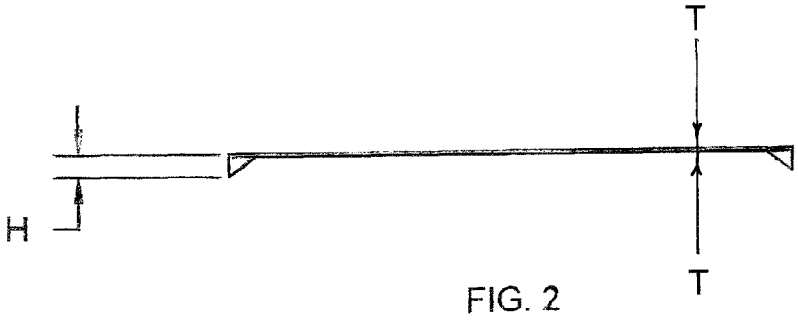
FIG. 2 shows a cross-sectional view of the first embodiment of the present invention along the cross-sectional lines II-II with the securing teeth bent normally to the flat blank sheet.
Figure 5:
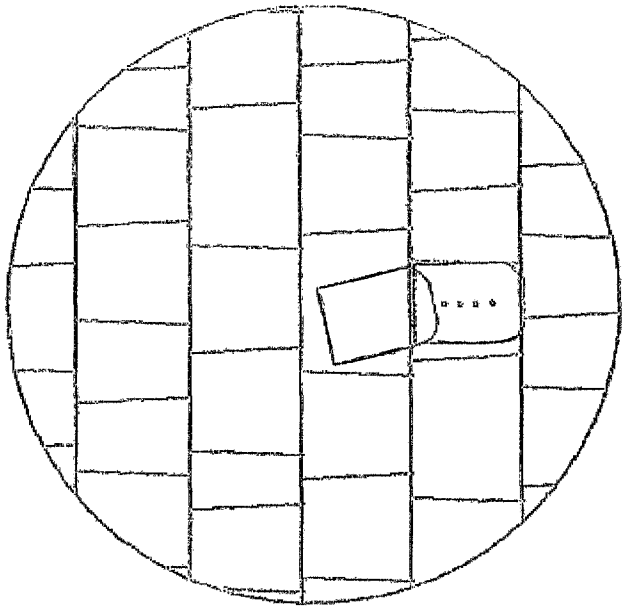
FIG. 5 is perspective view of how the present invention is inserted underneath an asphalt shingle with holes to be repaired.

Referring to FIGS. 1, 2 and 5, the first embodiment of the present invention is illustrated and includes an asphalt roof shingle sealing device comprised of a single flat blank sheet (1) of metal or rigid plastic. The blank sheet includes a top surface, a bottom surface, a top edge, a bottom edge and side edges. The metal can be selected from any non-corrosive metal, preferably aluminum or copper. The plastic can be selected from any polymeric material such as polyvinylchloride (PVC) or equivalent thereof having a certain degree of rigidity. The blank sheet has a width (W) of approximately 3.0 to 8.0 inches, preferably 4.0 inches, a length (L) of approximately 4.0 to 7.0 inches, preferably 5.50 inches, and a thickness (T) of approximately 0.010 to 0.018 inches, preferably 0.015 inches. Depending on the size of the shingle to be repaired, the dimensions are selected to span the width and length of the punctured shingle such that it can be easily inserted underneath the shingle to be repaired. To facilitate the insertion, the upper corners of the sheet upper edge are rounded and have a radius of curvature (R) of approximately 0.75 to 1.25 inches, preferably 1.0 inch. The lower corners of the sheet include teeth (1*a*) and (1*b*). In FIG. 1, the teeth are shown to extend in the plane of the blank sheet (1). Referring to FIG. 2, during use, the teeth are shown to be bent downward in a substantially normal direction to the plane of the blank sheet. Each tooth terminates into a point and has a height (H) of approximately 0.10 to 0.20 inches, preferably 0.17 inches. Although the above dimensions are for illustration purposes only, they are not to be construed as limiting the scope of the present invention and can vary due to new shingle designs that may come into the market place.

Several methods can be employed to secure the blank sheet in place underneath the repaired shingle.

In a first embodiment illustrated in FIGS. 1 and 2, after the blank sheet is inserted underneath a shingle to be repaired, the pair of teeth (1*a*) and (1*b*) extending normally from the lower surface thereof partially penetrate a shingle below the repaired shingle. This can be facilitated by slightly tapping the teeth into the upper surface of the lower shingle.

Figure 3:
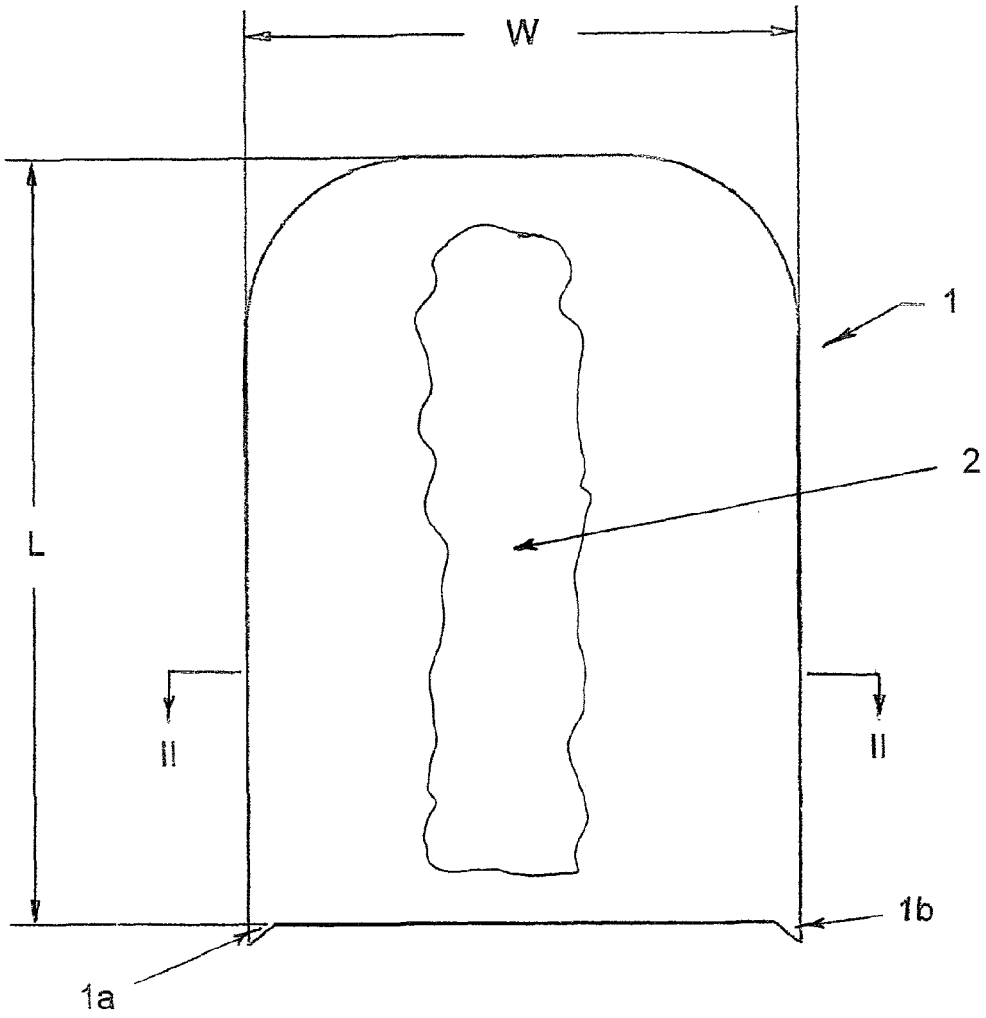
FIG. 3 is a top view of a second embodiment of the present invention similar to the embodiment illustrated in FIGS. 1 and 2 and having a layer (2) of flexible roof caulk disposed thereon. In use, the second embodiment will have the securing teeth bent normally to the flat blank sheet.

As illustrated in FIG. 3 of the second embodiment, a layer of conventional flexible roof caulk (2), such as conventional roofing cement or sealant, is extended across the top surface of the blank sheet particularly in the area over which the holes, tears or punctures would be located. After inserting the blank sheet underneath a shingle to be repaired, the flexible roof caulk will adhere to the underside surface of the repaired shingle and also fill the holes, tears or punctures thereby securing the blank sheet of the present invention in place. It is noted that this embodiment can be used with or without the normally extending teeth (1*a*) and (1*b*) as illustrated in FIG. 2.

Figure 4:
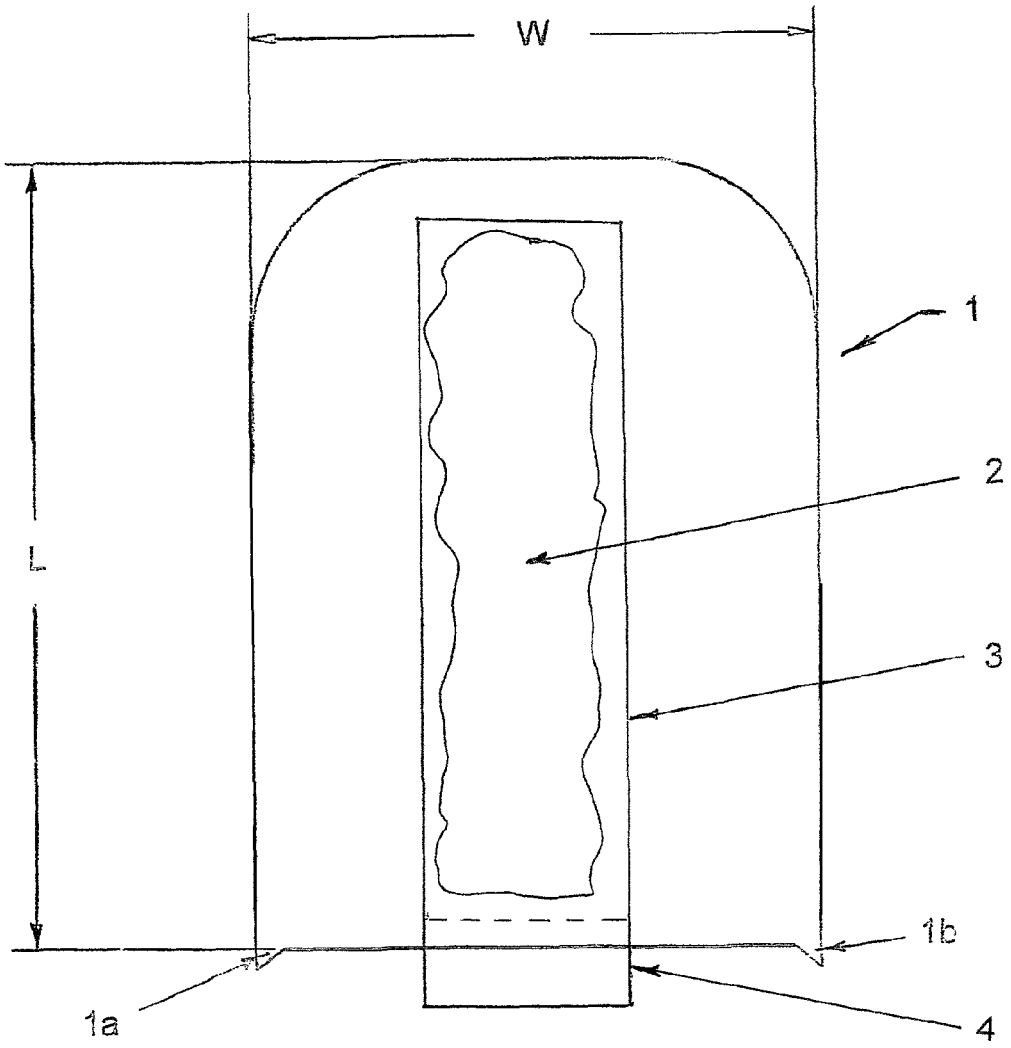
FIG. 4 is a top view of a third embodiment of the present invention similar to the embodiment illustrated in FIGS. 1, 2 and 3 and having a peal-back tape (3) over the layer (2) of flexible roof caulk which is folded over upon itself and terminates in tail (4). In use, the third embodiment will have the securing teeth bent normally to the flat blank sheet.

In a third embodiment illustrated in FIG. 4, a layer of conventional flexible roof caulk (2), such as conventional roofing cement or sealant, is extended across the top surface of the blank sheet particularly in the area over which the holes, tears or punctures would be located and a peel-back strip (3) is disposed over the layer of caulk which would then be removed once the blank sheet is inserted underneath a shingle to be repaired. The peel-back strip overlaps the caulk and may be folded over upon itself and extend into a tail (4) beyond the lower edge of the blank sheet to facilitate the removal thereof after the blank sheet is in place simply by pulling the peel-back strip from the blank sheet. As in the first and second embodiments, the flexible roof caulk will adhere to the underside surface of the repaired shingle and also fill the holes, tears or punctures thereby securing the blank sheet of the present invention in place. It is noted that this embodiment can be used with or without the normally extending teeth (1*a*) and (1*b*) as illustrated in FIG. 2. Furthermore, this embodiment is very useful for asphalt shingles that may be less flexible from aging and therefore, cannot be raised sufficiently enough for the blank sheet to be inserted without cracking. By slightly raising these type of shingles and inserting this embodiment of the present invention, the folded over peel-back strip will prevent any of the caulk from being scraped off the blank sheet when inserted. Once in place, the peel-back strip is removed exposing the caulk and allowing it to penetrate the holes, tears or punctures and seal with the underside of the shingle.

As discussed supra, the third embodiment may be made in two different ways. The caulk and peel-back strip could be applied to the blank sheet by the user at the time of repairing the shingle, or alternatively, the caulk and peel-back strip could be applied to the blank sheet during the manufacturing process of the present invention. In the latter case, the peel-back strip will not only overlap the caulk, but will be adhered to the top surface of the blank sheet around the periphery of the caulk to preserve the caulk in its uncured state until use.

Referring to FIG. 5, the process in which the present invention is applied to a single asphalt shingle is illustrated. Once the blank sheet is secured under the shingle to be repaired, any water passing through the holes, tears or punctures, whether because no roofing caulk was applied as in the first embodiment or whether roofing caulk was applied to the blank sheet as in the second or third embodiments but should fail for whatever reason, is collected by the blank sheet of the present invention and drains onto a shingle below the repaired shingle. However, in applying the present invention properly, once the caulk penetrates the holes, tears or punctures, no leakage should occur.

Figure 6:
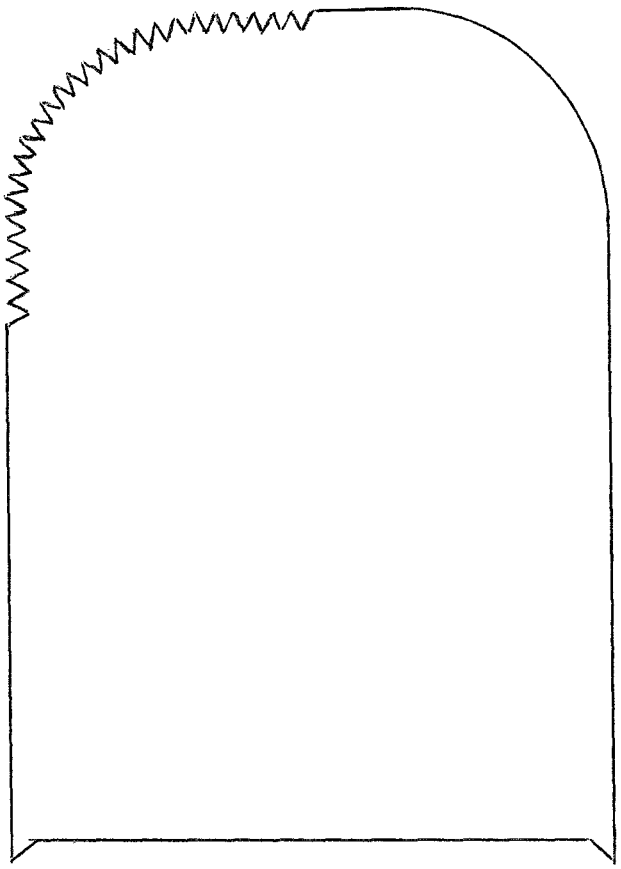
FIG. 6 is a perspective view of the present invention having a saw-toothed edge for facilitating cutting of an overlapping shingle away from an under shingle to allow insertion of the blank sheet between the two shingles.

Referring to FIG. 6, a modification of the blank sheet is illustrated. At least one of the rounded upper corners of the blank sheet is formed with a saw-toothed edge. Each of the above described embodiments may or may not include such a feature. On the majority of asphalt-shingled roofs, the lower edge of an overlapping shingle is held in place to an underlying shingle by an adhesive strip. The saw-toothed edge facilitates cutting through the strip of the adhesive. After the strip of adhesive is cut and the overlapping shingle is raised, the blank sheet can easily be inserted between the shingles. Although the saw-toothed edge as illustrated in FIG. 6 is shown as triangular-shaped teeth, any other shaped teeth or edge configuration could equally be employed such as square-shaped teeth or trapezoidal-shaped teeth.

The present invention has been described in terms of various embodiments. It will be appreciated by those skilled in the art that various changes and modifications may be made to the embodiments without departing from the spirit or scope of the invention. It is not intended that the invention be limited to the embodiments shown and described. It is intended that the invention include all foreseeable modifications to the embodiments shown and described. It is intended that the invention be limited in scope only by the claims appended hereto.

What is claimed is:

1. An asphalt roof shingle sealing device adapted to be inserted beneath an asphalt shingle-to-be-repaired having at least one hole, tear or puncture and that overlaps an asphalt shingle below said asphalt shingle-to-be-repaired comprising:

a flat non-perforated blank sheet of substantially rigid material having a top surface, a bottom surface, a top edge, a bottom edge, opposing side edges and a thickness (T);

said sheet has a length (L) extending between said top and bottom edges and a width (W) extending between said opposing side edges;

said length (L) and width (W) being approximately equal to the length and width of a conventional asphalt shingle;

said thickness (T) being selected such that said blank sheet fits beneath an asphalt shingle-to-be-repaired and a shingle below said shingle-to-be-repaired without substantially raising said shingle-to-be-repaired;

a securing mechanism for securing said blank sheet beneath an asphalt shingle-to-be-repaired; said securing mechanism comprises a layer of roofing cement or sealant disposed over said top surface of said blank sheet for penetrating said at least one hole, tear or puncture and adhere to the shingle-to-be-repaired;

a peel-back strip overlapping said layer of roofing cement or sealant, said peel-back strip terminating in a tail section extending from said bottom edge of said blank sheet for protecting said roofing cement or sealant prior to said blank sheet being inserted beneath said shingle-to-be-repaired; whereby said blank sheet is insertable beneath said at least one hole, tear or puncture of an asphalt shingle-to-be-repaired and secured therein by said securing mechanism such that any water leakage through said holes, tears or punctures will drain over said top surface of said blank sheet and onto a shingle below said shingle-to-be-repaired.

2. An asphalt roof shingle sealing device as claimed in claim 1 and further comprising:

said blank sheet width (W) is approximately 3.0 to 8.0 inches, said length (L) is approximately 4.0 to 7.0 inches, and said thickness (T) is approximately 0.010 to 0.018 inches.

3. An asphalt roof shingle sealing device as claimed in claim 1 and further comprising:

said blank sheet width (W) is approximately 4.0 inches, said length (L) is approximately 5.50 inches, and said thickness (T) is approximately 0.015 inches.

4. An asphalt roof shingle sealing device as claimed in claim 1 and further comprising:

said substantially rigid material comprising a non-corrosive metal or polymeric material.

5. An asphalt roof shingle sealing device as claimed in claim 4 and further comprising:

said substantially rigid material comprising aluminum or copper or polyvinylchloride (PVC).

6. An asphalt roof shingle sealing device as claimed in claim 1 and further comprising:

said peel-back strip folded over upon itself prior to terminating in said tail section extending from said bottom edge of said blank sheet.

7. An asphalt roof shingle sealing device as claimed in claim 1 and further comprising:

said peel-back strip overlapping said layer of roofing cement or sealant and being adhered to said top surface of said blank sheet around said caulk to preserve the caulk in its uncured state until use.

8. An asphalt roof shingle sealing device as claimed in claim 7 and further comprising:

said peel-back strip folded over upon itself prior to terminating in said tail section extending from said bottom edge of said blank sheet.

9. An asphalt roof shingle sealing device adapted to be inserted beneath an asphalt shingle-to-be-repaired having at least one hole, tear or puncture and that overlaps an asphalt shingle below said asphalt shingle-to-be-repaired comprising:

a flat non-perforated blank sheet of substantially rigid material having a top surface, a bottom surface, a top edge, a bottom edge, opposing side edges and a thickness (T);

said sheet has a length (L) extending between said top and bottom edges and a width (W) extending between said opposing side edges;

said length (L) and width (W) being approximately equal to the length and width of a conventional asphalt shingle;

said thickness (T) being selected such that said blank sheet fits beneath an asphalt shingle-to-be-repaired and a shingle below said shingle-to-be-repaired without substantially raising said shingle-to-be-repaired;

a securing mechanism for securing said blank sheet beneath an asphalt shingle-to-be-repaired;

said securing mechanism comprises a pair of teeth, a first tooth of said pair extending normally from a lower corner of said blank sheet and a second tooth of said pair extending from an opposite lower corner of said blank sheet; whereby said blank sheet is insertable beneath said at least one hole, tear or puncture of an asphalt shingle-to-be-repaired such that any water leakage through said holes, tears or punctures will drain over said top surface of said blank sheet and onto a shingle below said shingle-to-be-repaired and is secured in place by slightly tapping the teeth into the upper surface of an asphalt shingle below said asphalt shingle-to-be-repaired.

10. An asphalt roof shingle sealing device as claimed in claim 9 and further comprising:

said securing mechanism further comprises a layer of roofing cement or sealant disposed over said top surface of said blank sheet; whereby said roofing cement or sealant will penetrate said at least one hole, tear or puncture and adhere to the shingle-to-be-repaired.

11. An asphalt roof shingle sealing device as claimed in claim 10 and further comprising:

a peel-back strip overlapping said layer of roofing cement or sealant, said peel-back strip terminating in a tail section extending from said bottom edge of said blank sheet; whereby said peel-back strip protects said roofing cement or sealant prior to said blank sheet being inserted beneath said shingle-to-be-repaired.

12. An asphalt roof shingle sealing device as claimed in claim 11 and further comprising:

said peel-back strip folded over upon itself prior to terminating in said tail section extending from said bottom edge of said blank sheet.

13. An asphalt roof shingle sealing device as claimed in claim 11 and further comprising:

said peel-back strip overlapping said layer of roofing cement or sealant and being adhered to said top surface of said blank sheet around said caulk to preserve the caulk in its uncured state until use.

14. An asphalt roof shingle sealing device as claimed in claim 13 and further comprising:

said peel-back strip folded over upon itself prior to terminating in said tail section extending from said bottom edge of said blank sheet.

15. An asphalt roof shingle sealing device as claimed in claim 9 and further comprising:

each said tooth terminates into a point and has a height (H) of approximately 0.10 to 0.20 inches.

16. An asphalt roof shingle sealing device as claimed in claim 9 and further comprising:

each said tooth terminates into a point and has a height (H) of approximately 0.17 inches.

17. An asphalt roof shingle sealing device as claimed in claim 1 and further comprising:

said blank sheet having rounded opposing upper corners wherein at least one of said rounded corners defines a modified edge extending around said at least one rounded corner and formed with a cutting configuration.

18. An asphalt roof shingle sealing device as claimed in claim 17 and further comprising:

said blank sheet having rounded opposing upper corners that have a radius of curvature (R) of approximately 0.75 to 1.25 inches.

19. An asphalt roof shingle sealing device as claimed in claim 18 and further comprising:

said blank sheet having rounded opposing upper corners that have a radius of curvature (R) of approximately 1.0 inch.

20. An asphalt roof shingle sealing device as claimed in claim 17 wherein said cutting configuration is a saw-toothed configuration, whereby an overlapping shingle could easily be cut away from an underlying shingle.

21. An asphalt roof shingle sealing device as claimed in claim 20 wherein said modified edge extends around at least one of said rounded corners and further edge sections adjacent to said at least one rounded corner.

22. An asphalt roof shingle sealing device as claimed in claim 18 wherein said blank sheet defines a modified edge extending around at least one of said rounded corners, said modified edge formed with a saw-toothed configuration, whereby an overlapping shingle could easily be cut away from an underlying shingle.

23. An asphalt roof shingle sealing device as claimed in claim 22 wherein said modified edge extends around at least one of said rounded corners and further edge sections adjacent to said at least one rounded corner.

24. An asphalt roof shingle sealing device as claimed in claim 19 wherein said blank sheet defines a modified edge extending around at least one of said rounded corners, said modified edge formed with a saw-toothed configuration, whereby an overlapping shingle could easily be cut away from an underlying shingle.

25. An asphalt roof shingle sealing device as claimed in claim 24 wherein said modified edge extends around at least one of said rounded corners and further edge sections adjacent to said at least one rounded corner.

* * * * *